US008192253B2

(12) United States Patent
Seo et al.

(10) Patent No.: US 8,192,253 B2
(45) Date of Patent: Jun. 5, 2012

(54) FINISHING APPARATUS

(75) Inventors: Sung Keun Seo, Seoul (KR); Dae Jin Jeong, Seoul (KR); Seung Bae Lee, Seoul (KR); Jin Soo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1063 days.

(21) Appl. No.: 12/114,933

(22) Filed: May 5, 2008

(65) Prior Publication Data

US 2008/0274679 A1 Nov. 6, 2008

(30) Foreign Application Priority Data

May 4, 2007 (KR) ..... 10-2007-0043478

(51) Int. Cl.
*B24B 21/00* (2006.01)

(52) U.S. Cl. ..... 451/303; 451/311

(58) Field of Classification Search ..... 451/297, 451/303, 311; 474/102, 103, 104, 106, 110
See application file for complete search history.

(56) References Cited

U.S. PATENT DOCUMENTS

| | | | | |
|---|---|---|---|---|
| 2,007,967 | A * | 7/1935 | Gardner | 451/303 |
| 3,801,293 | A * | 4/1974 | Kiser | 451/57 |
| 4,337,598 | A * | 7/1982 | Barth et al. | 451/1 |
| 5,399,125 | A * | 3/1995 | Dozier | 474/117 |
| 6,290,570 | B1 * | 9/2001 | Heesemann | 451/5 |
| 6,561,870 | B2 * | 5/2003 | Saldana et al. | 451/10 |
| 6,726,545 | B2 * | 4/2004 | Balakumar et al. | 451/59 |
| 6,746,320 | B2 * | 6/2004 | Krusell et al. | 451/302 |
| 6,769,970 | B1 * | 8/2004 | Taylor et al. | 451/59 |
| 6,837,779 | B2 * | 1/2005 | Smith et al. | 451/307 |
| 7,591,061 | B2 * | 9/2009 | Taylor | 29/428 |
| 2002/0009952 | A1 * | 1/2002 | Walker et al. | 451/41 |
| 2004/0018808 | A1 * | 1/2004 | Lin et al. | 451/311 |

* cited by examiner

*Primary Examiner* — Timothy V Eley
(74) *Attorney, Agent, or Firm* — Fish & Richardson P.C.

(57) ABSTRACT

A hair-line processing, and more particularly a sheet metal finished by continuous hair-line on its plane and curved surface, and apparatus and method for finishing by continuous hair-line on the same are disclosed, wherein the sandpaper curvaceously advances to form hairlines relative to curved surface of the sheet metal, and operation of a pressure unit can vary the curvaceous degree of the sandpaper to form a continuous hairline relative a sheet metal including curved surfaces each having a different curvature.

14 Claims, 6 Drawing Sheets

FINISHING APPARATUS

CROSS-REFERENCE TO RELATED APPLICATION

The present application is based on, and claims priority from, Korean Application Number 10-2007-0043478 filed May 4, 2007, the disclosure of which is incorporated herein by reference in its entirety.

BACKGROUND

The following description relates generally to a hair-line processing. In on implementation, sheet metal is finished by continuous hair-line on its plane and curved surface, using an apparatus and a method for finishing by continuous hair-line on the same.

Typically, metal materials have intrinsic metallic luster, high-quality external impression, high strength and durability, distinguishing them from other materials that are less continuously and widely used. Metal materials have been used, of late, as sheet metals forming exterior casing parts of mobile communication terminals, i.e., cellular phones and personal digital assistants. In other words, formed sheet metals are employed as materials for use in casings and housings of hand-held electronic products.

Metal processing such as brushing or polishing of the metal surface may provide the intrinsic metal gloss, but such processing suffers from a shortcoming that a simple metal luster may cause a monotonous feeling to a user. Particularly, for products such as mobile communication terminals that attach importance to exterior designs, surface finishing or processing methods for sheet metals have been developed to cater to a variety of consumer demands amidst decorating the exterior appearance with sheet metals.

One such method is a sheet metal developed to generate a decorative effect by forming straight fine hairlines on the surface. The hairline surface finishing is designed to form straight fine hairlines on the surface of a smooth-polished sheet metal performed by steel-brushing or polishing to provide a decorative beauty to the exterior appearance, thus removing the monotonous metallic luster.

The hairline finishing typically performed by manual works that employ rotating sandpaper or steel brushes suffers from shortcomings that many labor hours and low productivity are involved. Another shortcoming is that a space between the hairlines and each length of the hairlines varies responsive to skill and function of a worker to make it difficult to maintain a constant quality level.

Yet another shortcoming is that it is very difficult to process a curved surface of a sheet metal although it may be possible to process the hairlines on a plane surface of the sheet metal using the conventional hairline finishing method, considering that there are a curved surface and a plane surface mixedly arranged on an exterior surface of the mobile communication terminal. Particularly, it is difficult to form continuous uniform hairlines from one plane surface to another plane surface through a curved surface when the curved surface exists between said one plane and said another plane surface.

Meanwhile, hairline surface finishes may be erased by pressing work in the course of pressing process, a distance between hairlines may be worn out by stretching of the curved surface portions, or external appearance may be damaged by efflorescence that is characteristic to metal materials, when hairlines are first processed on one surface of a sheet metal and the sheet metal is processed to have a curved surface through press process including post-operation.

As a result, there have been cases where a hairline surface finish is carried out only on a partial plane surface, where the hairline surface finish can be performed in case of a sheet metal, where a plane surface and a curved surface are mixedly available, and the hairline surface finish is discarded on the curved surface portions. In other words, the hairlines are formed only on the plane surface of a sheet metal where both the plane surface and the curved surface exist at the same time, but a sheet metal having continuous hairlines even on the curved surface has yet to be developed.

SUMMARY

In one general concept, a finishing apparatus imparts hairlines extending continuously along a plane surface and a curved surface of a sheet metal. The apparatus includes a closed belt of sandpaper; rotatable rollers having a relative orientation that defines a closed and curved path and being configured to facilitate rotational movement of the sandpaper along the closed and curved path; a holder unit, arranged between at least two of the rotatable rollers, to engage the sheet metal and to facilitate contact between a surface of the sheet metal and an opposing surface of the sandpaper; and a pressure inducing unit, arranged between the holder unit and the rotatable roller adjacent the holder unit, to exert a force against the sandpaper that is directed from an interior to an exterior of the closed and curved path that is defined by the rotatable rollers.

Various aspects of this concept are described with respect to implementations thereof. For instance, the holder unit may be further configured to support the sheet metal and promote contact between the sheet metal surface and the sandpaper surface. The holder unit may also or alternatively include a support unit configured for insertion and support of the sheet metal; and an XY table for adjusting a position of the support unit within the plane surface. The holder unit may further comprise a spring for resiliently supporting the support unit, a lift unit for vertically ascending and descending the support unit and/or a fixation unit fixedly disposed inside the close curved line to restrain an upper dead point of the lift unit, with or without the aforementioned spring.

Moreover, a position of at least a first one of the rotatable rollers may be adjustable relative to at least one other of the rotatable rollers, wherein movement of the first rotatable roller relative to the other rotatable rollers causes a change in tension applied to the sandpaper.

Furthermore, a wobble prevention stabilizer that is positioned at an upstream side of the holder unit based on a direction of rotation of the sandpaper during operation. The wobble prevention stabilizer may include a roller contacting the sandpaper from the interior of the closed and curved path that is defined by the rotatable rollers.

Still further, the pressure unit may include a hydropneumatic cylinder elastically applying force from an interior to an exterior of the closed and curved path that is defined by the rotatable rollers; and a pressure roller that is positioned by a rod of the hydropneumatic cylinder and configured to contact the sandpaper from the interior of the closed and curved path that is defined by the rotatable rollers. And, a pair of pressure units are disposed such that a pressure unit is located at each side about the holder unit, similarly or differently configured.

The sandpaper may be coated with particles of strong magnetic substance; and the pressure inducing unit may include a magnet disposed at the holder unit. As such, the holder unit may include a support unit in which the sheet metal is inserted; and an XY table for operating the support unit within the plane surface, wherein the magnet is inserted into the support unit.

In another general aspect, a method for finishing by continuous hairline on a plane surface and a curved surface of a sheet metal includes rotating a closed belt of sandpaper along a closed and curved path including a linear region; arranging the sheet metal with an upper surface of the sheet metal contacting the sandpaper from outside of the closed belt and under the linear region thereof; and curvaceously descending the sandpaper by moving the sandpaper from a position where the linear region of the sheet metal exerts relatively little or no tension against the sandpaper surface to a position where the linear region of the sheet metal exerts relatively significant tension on the sandpaper.

In this general aspect, curvaceously descending the sandpaper comprises lowering an ascending and descending pressure unit disposed inside the closed and curved path to downwardly to press against at least one portion of the sandpaper adjacent an area of the sandpaper corresponding to the linear region of the sheet metal. Moreover, curvaceously descending the sandpaper may include forming a magnetic field on the sheet metal while the sandpaper is coated with particles of strong magnetic substance.

In yet another general aspect, a sheet metal may have continuous and parallel hairlines on its plane and curved surface, the sheet metal having continuous and parallel hairlines across the curved surface and the plane surface adjacent the curved surface, wherein one part of the sheet metal includes the curved surface and the other part of the sheet metal includes the plane surface.

DETAILED DESCRIPTION

Now, exemplary implementations will be described in detail with reference to the accompanying drawings.

Figure 1:
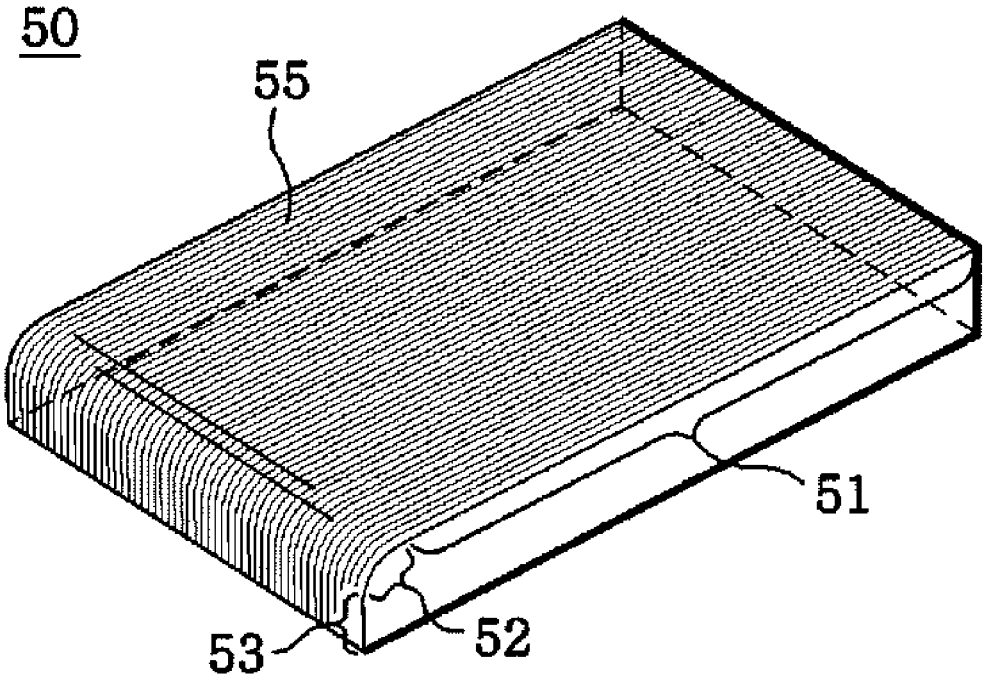
FIG. 1 is a perspective view illustrating an exemplary implementation of a sheet metal continuously processed with hairlines across a plane and curved surface.

Referring to FIG. 1, a sheet metal (50) that includes both plane surfaces (51, 53) and a curved surface (52) may be a sheet form made of metal material, i.e., stainless steel, magnesium, duralumin and aluminum. Specifically, the curved surface (52) is available between the plane surface (51) on an upper surface of the sheet metal (50) and the plane surface (53) on a lateral surface of the sheet metal (50), and hairlines (55) are continuously formed from the plane surface (51) on an upper surface of the sheet metal (50) to the plane surface (53) on a lateral surface of the sheet metal (50) via the curved surface (52).

Figure 2:
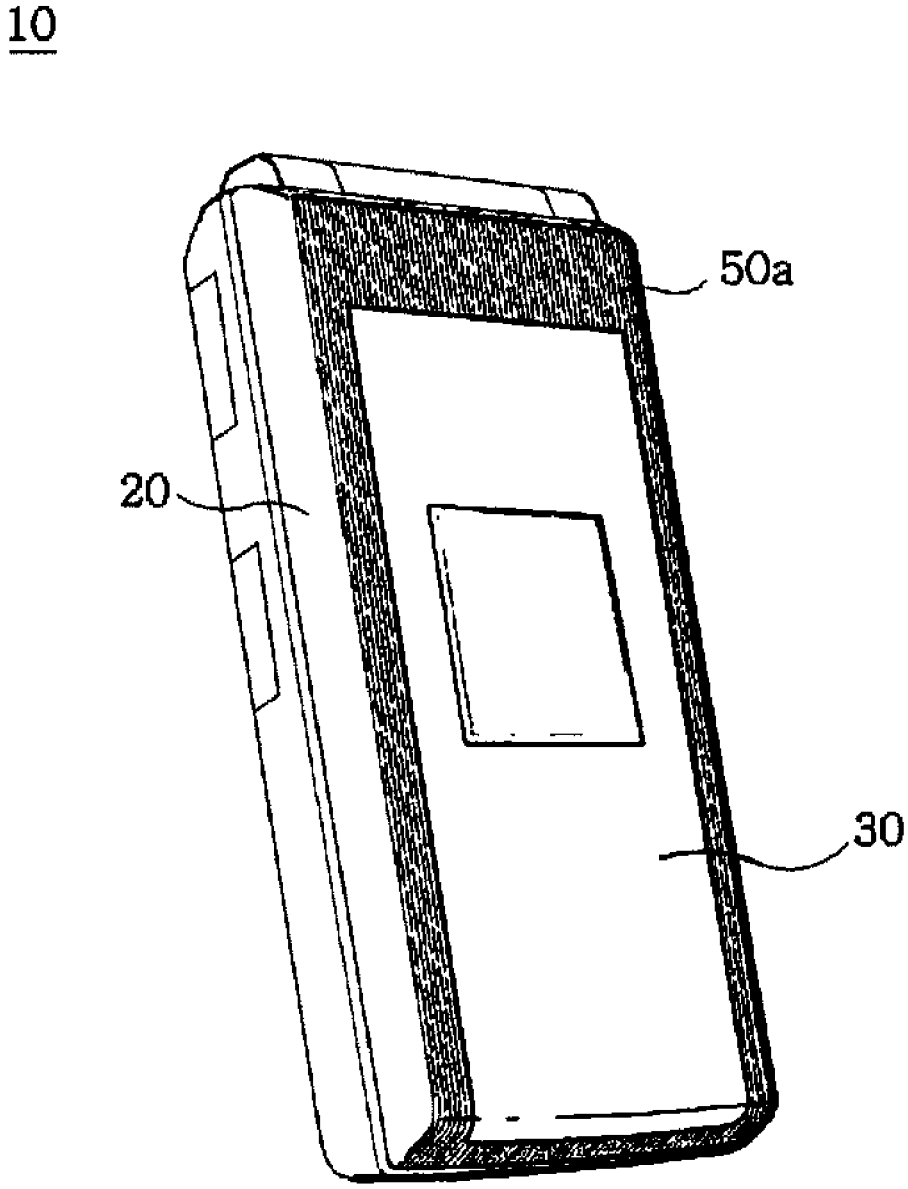
FIG. 2 is a perspective view illustrating a mobile communication terminal applied with a sheet metal processed with continuous hairlines across the curved and plane surface.

Now, referring to FIG. 2, an exterior unit of a cover (20) disposed on a mobile communication terminal (10) may be applied with a sheet metal (50*a*) having a shape into which a display unit (30) is inserted by partially cutting the sheet metal (50) finished by continuous hairlines across the plane and curved surface of the sheet metal (50) of FIG. 1. In case of the mobile communication terminal (10) having the sheet metal (50*a*) formed with the hairlines, a user may enjoy a decorative effect by dint of the hairlines and an intrinsic metal texture that cannot be felt by and is absolutely different from a smooth metal surface through dispersion of light incident on the surface. Furthermore, the user may advantageously feel an improved grip feeling by the hairlines when holding the mobile communication terminal (10) and prevent the slippage from the hands.

Figure 3:
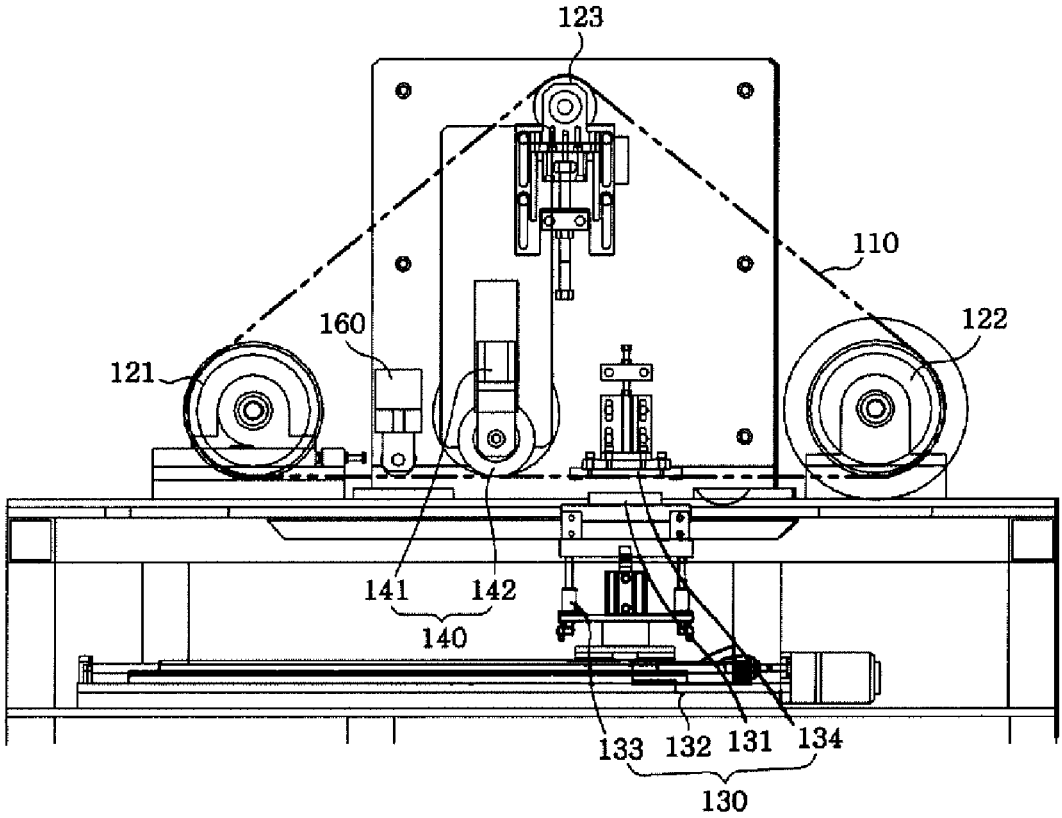
FIG. 3 is a front view illustrating an exemplary implementation of an apparatus for finishing by continuous hairlines on the plane and curved surface.

Referring now to FIG. 3, the sheet metal (50) may be basically the same as that of FIG. 1, but a sheet metal that has not been finished by the hairlines. In other words, the sheet metal (50) is in a semi-fabricated state for being loaded into an apparatus for finishing by continuous hairlines in order to get a uniform metal luster by the conventional polishing method.

Sandpaper (110) may be prepared by being coated with abrasives on one side of a material such as a piece of cloth. The sandpaper is flexible and has a circular belt shape.

The sandpaper (110) may circulatorily rotate along a discretionary closed curved line formed by a plurality of rotating rollers (121, 122, 123). In other words, as illustrated in FIG. 3, the sandpaper (110) may be arranged between the first rotating roller (121) and the second rotating roller (122). The first rotating roller (121) is rotated by rotating mechanism, such as an electric motor, while the second rotating roller (122) is left to freely rotate, whereby the sandpaper (110) is continuously circulatorily rotated between the first and second rotating rollers (121, 122).

Meanwhile, the third rotating roller (123) may be further disposed inside the closed curved line formed by the sandpaper (110), where it is preferable that the third rotating roller (123) be operated inward and outward of the closed curved line in order to adjust the tension of the sandpaper (110).

A holder unit (130) may be made to support the sheet metal (50) to allow an upper surface of the sheet metal (50) to contact a bottom surface of the sandpaper (110) that is continuously and circulatorily rotated. To this end, the holder unit (130) may be arranged between a pair of adjacent rotating rollers (121, 122) out of the plurality of rotating rollers (121, 122, 123). Meanwhile, it is preferable that the sheet metal (50) be horizontally moved or vertically ascended or descended. The movement of the sheet metal (50) by the holder unit (130) within a horizontal surface may ease the downward movement of the sandpaper (110) at the start of the processing when the sheet metal (50) is fixedly inserted into the holder unit (130), and may improve the processing convenience as the sheet metal (50) can be moved to a lengthwise or breadthwise direction of the sandpaper (110) to finish the hairlines, in case of need even during the processing.

The vertical movement of the sheet metal (50) by the holder unit (130) may also ease the movement of sheet metal (50) downward of the sandpaper (110) to further enable the adjustment of a contact pressure between the sandpaper (110) and the sheet metal (50), whereby quality including, i.e., density and length of hairlines to be formed on the sheet metal (50) can be adjusted.

Figure 4:
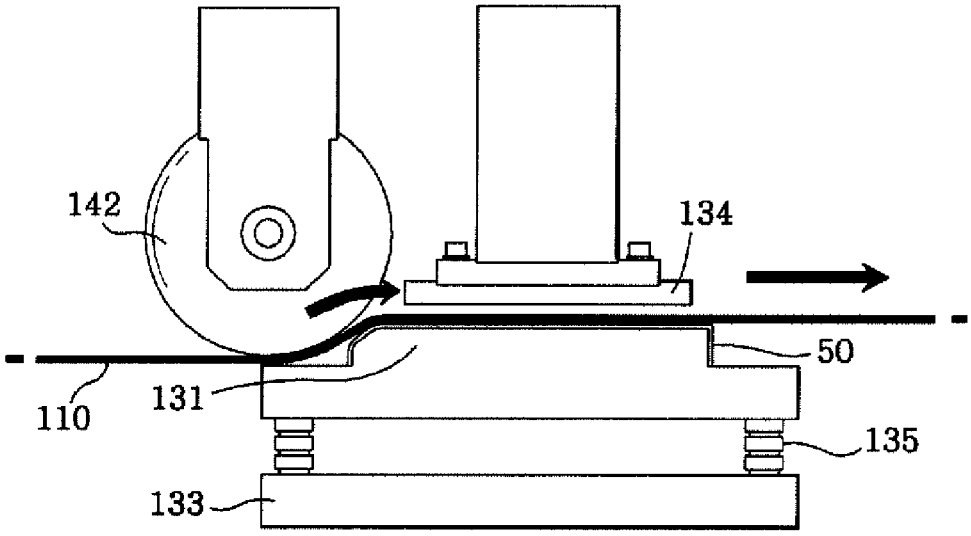
FIG. 4 is a cross-sectional view of a holder unit according to the exemplary implementation of FIG. 3.

In view of the foregoing, the holder unit (130) may include a support unit (131) for insertedly supporting the sheet metal (50), an XY table (132) for operating the support unit (131) within a plane surface, or a lift unit (133) for vertically ascending or descending the support unit (131). The holder unit (130) may include the XY table (132) and the support unit (133) at the same time. It may be desirable to elastically support the support unit (131) in order to resiliently support the contact between the sandpaper (110) and the sheet metal (50) while the holder unit (130) is incapable of vertically operating the sheet metal. To this end, as shown in FIG. 4, a spring (135) as a resilient member may be formed between the support unit (131) and the lift unit (133) or the XY table (132). The spring (135) may be mounted beneath the lift unit (133) or the XY table (132) to resiliently support the entire holder unit (130) relative to a floor surface on which the apparatus of the instant novel concept is to be installed or a separate frame. Preferably, the apparatus according to the present disclosure may further include a fixedly mounted fixation block (134) for restraining an upward movement of the holder unit (130) within the closed curved line drawn by the sandpaper (110), so that the contact pressure between the sandpaper (110) and the sheet metal (50) can be reinforced and stably maintained.

A pressure unit (140) may be mounted to apply pressure to the sandpaper (110) from inside of the closed curved line drawn by the sandpaper (110) to outside of the closed curved line. In other words, the pressure unit (140) may be disposed between the holder unit (130) and any one rotating roller (121) adjacent to the holder unit (130). Particularly, the pressure unit (140) may apply a downward pressure to the sandpaper (110) when the holder unit (130) leads an upper surface of the sheet metal (50) to contact a bottom surface of the sandpaper (110).

Referring to FIG. 4, when a pressure roller (142) functioning as the pressure unit (140) applies pressure to the sandpaper (110) up to a position which is lower than that of the upper surface of the sheet metal (50) fixed at the holder unit (130), the sandpaper (110) advances forming a curvaceous surface connecting the upper surface of the holder unit (130) and the bottom end of the pressure roller (142). As a result, the sandpaper (110) curvaceously advances at a lateral surface of the sheet metal (50), and the sandpaper (110) advances linearly at the upper surface of the sheet metal (50), thus enabling to finish a continuous hairline. In order to adjust the curvaceous degree of the sandpaper (110), there is a need of adjusting the descending degree of the pressure unit (140), such that it is preferable that the pressure unit (140) include a contact unit contacting the sandpaper (110), and a configuration capable of linearly operating the contact unit. For example, the contact unit may be installed with a guide shoe and a guide rail for guiding the guide shoe, whereby the contact unit is manually and vertically operated, and then fixed at an appropriate position to thereby realize the pressure unit (140).

The contact being directly brought into contact with the sandpaper (110), it is preferable that the contact unit be a roller-shaped pressure roller (142) in order to minimize the damage of sandpaper (110) caused by friction. It is also preferable that the pressure roller (142) be mounted at a distal end of a rod of a hydropneumatic cylinder (141) that is flexibly operated to enable an automatic manipulation of the pressure unit (140). The pressure unit (140) being capable of change the curvaceous degree of the sandpaper (110), it may be possible to adjust the curvaceous degree of the sandpaper (110) in accordance with the changing curvature of the curved surface formed at the sheet metal (50), even if the curvature is changed.

Meanwhile, there may be generated a vibration at the sandpaper (110) in response to the circulating speed thereof. When the sandpaper (110) vibrates to be brought into contact with the sheet metal (50), the hairlines formed at the sheet metal (50) may have an irregular shape, which necessitates restraining the vibration of the sandpaper (110). The vibration of the sandpaper (110) becomes worsened as a space between each rotating rollers (121, 122, 123) is widened and the circulating speed of the sandpaper (110) grows faster. Therefore, it is preferable to install wobble prevention mechanism (160) at an upstream side of the holder unit (130) for preventing the vibration of the sandpaper (110). The upstream side of the holder unit (130) is based on the circulating direction of the sandpaper (110), such that, in order to obviate the vibration of the sandpaper, the holder unit (130) may have to be brought into contact with the wobble prevention mechanism (160) before the sandpaper (110) enters the holder unit (130). Although it may be sufficient that the wobble prevention mechanism (160) is a bar having a curvaceous surface that contacts the sandpaper (110) as shown in FIG. 3, it is preferable that the wobble prevention mechanism (160) include an idle roller for minimizing the damage of sandpaper (110) caused by contact friction.

Although the exemplary implementations have described the formation of a curved surface at one side of the sheet metal (50) relative to the advancing direction of the sandpaper (110), the sheet metal (50) may be formed with the curved surface at both sides thereof.

Figure 5:
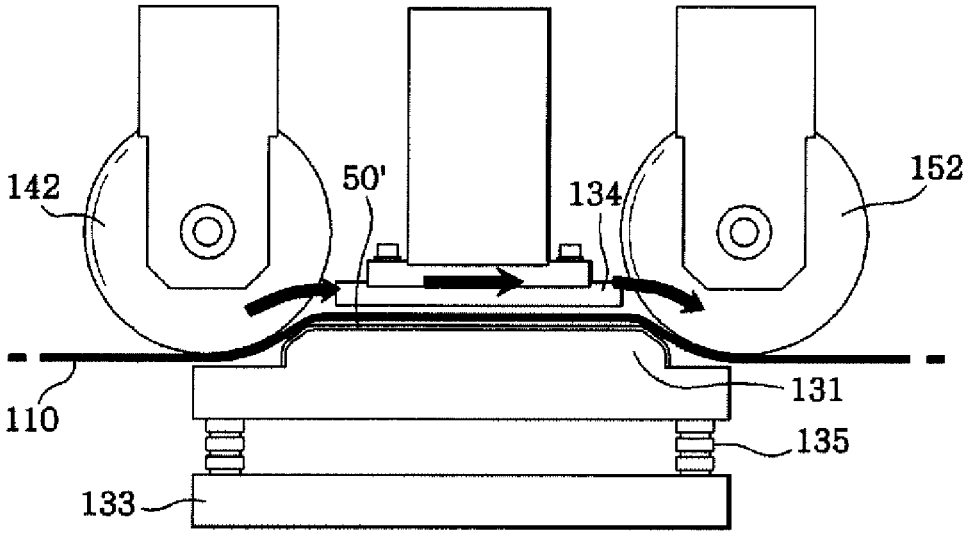
FIG. 5 is a partially cutaway view of a holder unit according to another exemplary implementation of an apparatus for finishing by continuous hairlines on the plane and curved surface.

FIG. 5 is a partially cutaway view of a holder unit according to another exemplary implementation of an apparatus for finishing by continuous hairlines on the plane and curved surface, where the process of a sheet metal (50') formed with the curved surface at both sides is implemented.

Referring to FIG. 5, a pressure unit may be disposed at each side of the sheet metal about the holder unit (130). In other words, pressure rollers (142, 152) may be disposed at either side of the support unit (131) of the holder unit (130) to allow forming hairlines on both sides of the sheet metal (50'). The pair of pressure units has the identical construction and operational function albeit in different positions.

Figure 6:
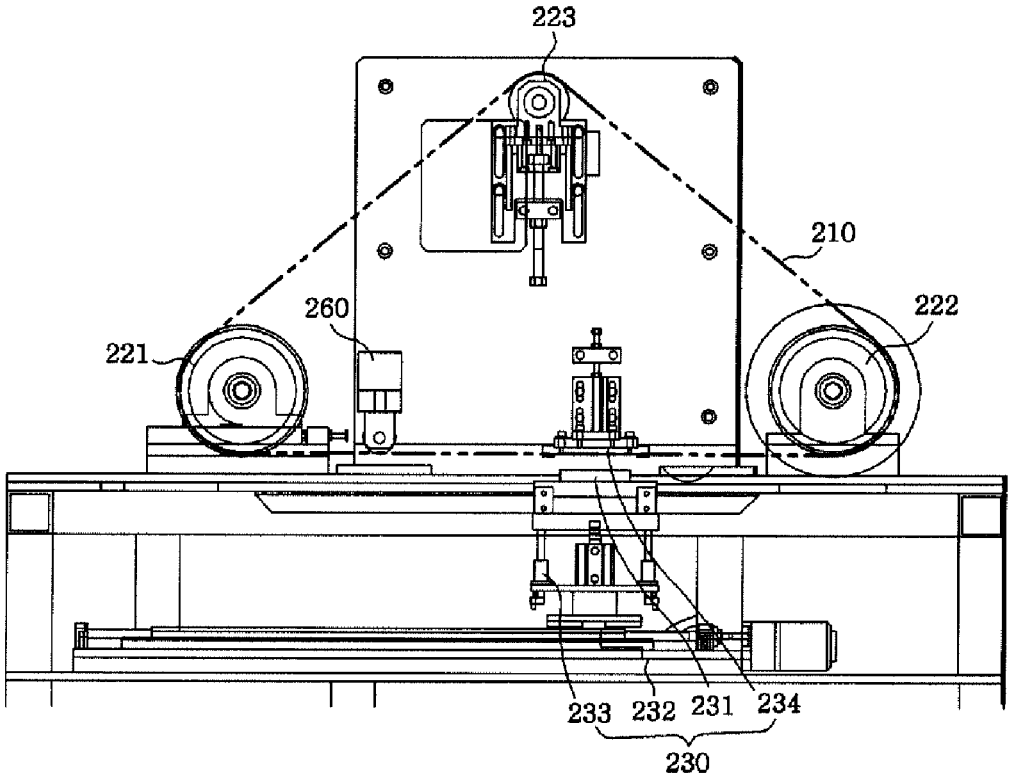
FIG. 6 is a front view of still another exemplary implementation of an apparatus for finishing by continuous hairlines on the plane and curved surface.
Figure 7:
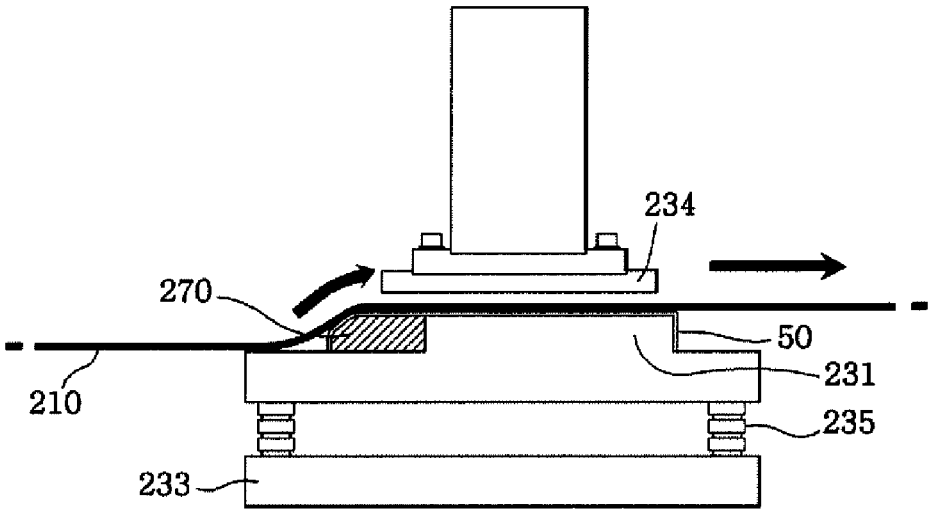
FIG. 7 is a partially cutaway view of a holder unit of the exemplary implementation of FIG. 6.

FIG. 6 is a front view of still another exemplary implementation of an apparatus for finishing by continuous hairlines on the plane and curved surface, and FIG. 7 is a partially cutaway view of a holder unit of the exemplary implementation of FIG. 6.

Although the pressure unit (140) of the previous exemplary implementations is omitted in the present exemplary implementation, a magnet (270) is mounted instead at a support unit (230) of a holder unit (230). The magnet (270) may be a permanent magnet or an electro-magnet. Sandpaper (210) is coated with materials attracting magnetic substances, i.e., particles of magnetic substance. The sandpaper, being coated with particles of magnetic substance, may be securely contacted at a support unit (231) of the holder unit (230) by the magnetic force of the magnet (270), where the sandpaper advances to contact a plane surface of a sheet metal (50) inserted into the support unit (231) and a curved surface as well. In so doing, the sheet metal (50) may be finished by continuous hairlines from the plane surface to the curved surface.

In the present exemplary implementation, sandpaper (210), rotating rollers (221, 222, 223), the holder unit (230), lift unit (233), fixedly mounted fixation block (234), spring (235), and wobble prevention mechanism (260) have identical corresponding constructions and operation functions as those of the previous exemplary implementations, such that detailed description thereto will be omitted herein.

Figure 8:
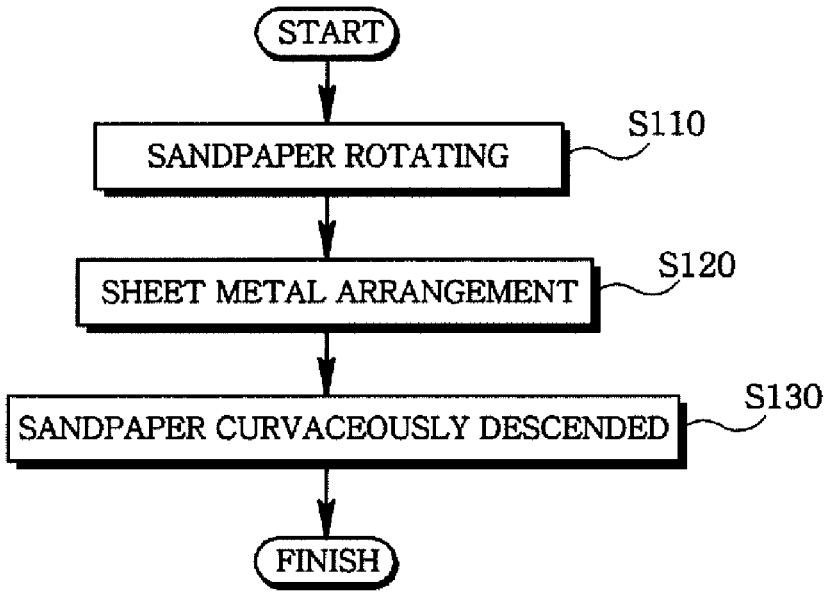
FIG. 8 is a flowchart of an exemplary implementation of a method for finishing by continuous hairlines on the plane and curved surface.

FIG. 8 is a flowchart of an exemplary implementation of a method for finishing by continuous hairlines on the plane and curved surface.

In order to process a sheet metal mixedly disposed with plane surfaces and curved surfaces finished by continuous hairlines, circular belt-shaped sandpaper draws a closed curved line and circulatorily rotates on the closed curved line having a straight region (S110).

The sheet metal of work piece is so arranged as to contact the sandpaper at an upper surface thereof from a bottom side of the circulating sandpaper (S120). The sheet metal is a formed sheet material formed with plane surfaces and curved surfaces as well. Furthermore, a position where the sheet metal contacts the sandpaper must be on a linear region of the closed curved line.

Successively, the sandpaper is curvaceously descended at a position adjacent to the sheet metal, while the sheet metal is brought into contact with the sandpaper (S130). One of the detailed methods for curvaceously descending the sandpaper may be to press the sandpaper downwardly by descending a pressure unit disposed inside the closed curved line drawn by the sandpaper. Another method may be to form a strong electromagnetic field on the sheet metal by coating the sandpaper with particles of strong magnetic substance, thereby causing the sandpaper to be attracted toward the sheet metal by the magnetic force. In other words, the sandpaper is curvaceously descended, not by the physical contact but by the magnetic force. Through these processes, the sandpaper is curvaceously descended to be brought into contact with the plane surfaces and the curved surfaces of the sheet metal, whereby the sheet metal is finished by hairlines on both the plane surfaces and the curved surfaces.

As indicated, in at least one implementation, a structure (e.g., shown in FIG. 3) allows sandpaper 110 to be rotated around rollers 121/122/123, effecting sanding of a surface between rollers 121/122, with tension being increased or decreased by adjusting the distance between roller 123 and a plane extending between rollers 121/122. This structure includes pressure units 140 (with rollers 142, 152) that imparts a force perpendicular to the plane extending between rollers 121/122. This structure also includes a wobble prevention mechanism 160 that dampens vibrations in the sandpaper, as it rotates, to refine the intended pattern that otherwise distorts. This structure works in concert with holding unit 130, which applies tension upward on the sheet metal between support unit 131 and fixation block 134, and which enables movement of the sheet metal relative to the structure (exemplary detail shown in FIGS. 4 and 5).

While the present disclosure provides particular illustrative implementations, it is not intended to restrict the concepts herein to those implementations. Rather, changes or modifications are contemplated without departing from the scope and sprit of the present disclosure.

What is claimed is:

1. A finishing apparatus that imparts hairlines extending continuously along a plane surface and a curved surface of a sheet metal, the apparatus comprising:

a closed belt of sandpaper;

rotatable rollers having a relative orientation that defines a closed and curved path and being configured to facilitate rotational movement of the sandpaper along the closed and curved path;

a holder unit, arranged between at least two of the rotatable rollers, to engage the sheet metal and to facilitate contact between a surface of the sheet metal and an opposing surface of the sandpaper; and a pressure inducing unit, arranged between the holder unit and the rotatable rollers adjacent the holder unit, to exert a force against the sandpaper that is directed from an interior to an exterior of the closed and curved path that is defined by the rotatable rollers, wherein the pressure inducing unit comprises:

a hydropneumatic cylinder elastically applying force from an interior to an exterior of the closed and curved path that is defined by the rotatable rollers; and a pressure roller that is positioned by a rod of the hydropneumatic cylinder and configured to contact the sandpaper from the interior of the closed and curved path that is defined by the rotatable rollers.

2. The apparatus as claimed in claim 1, the holder unit is further configured to support the sheet metal and promote contact between the sheet metal surface and the sandpaper surface.

3. The apparatus as claimed in claim 1, wherein a position of at least a first one of the rotatable rollers is adjustable relative to at least one other of the rotatable rollers, wherein movement of the first rotatable roller relative to the other rotatable rollers causes a change in tension applied to the sandpaper.

4. The apparatus as claimed in claim 1, further comprising a wobble prevention stabilizer that is positioned at an upstream side of the holder unit based on a direction of rotation of the sandpaper during operation.

5. The apparatus as claimed in claim 4, wherein the wobble prevention stabilizer comprises a roller contacting the sandpaper from the interior of the closed and curved path that is defined by the rotatable rollers.

6. The apparatus as claimed in claim 1, wherein the pressure inducing unit includes a pair of pressure inducing units, the pair of pressure inducing units being disposed such that the pressure inducing unit is located at each side about the holder unit.

7. The apparatus as claimed in claim 1, wherein the holder unit comprises:

a support unit configured for insertion and support of the sheet metal; and an XY table for adjusting a position of the support unit within the plane surface.

8. The apparatus as claimed in claim 7, wherein the holder unit further comprises a spring for resiliently supporting the support unit.

9. The apparatus as claimed in claim 7, wherein the holder unit further comprises a lift unit for vertically ascending and descending the support unit.

10. The apparatus as claimed in claim 9, wherein the holder unit further comprises a spring for resiliently supporting the support unit.

11. The apparatus as claimed in claim 9, wherein the holder unit further comprises a fixation unit fixedly disposed inside a close curved line to restrain an upper dead point of the lift unit.

12. The apparatus as claimed in claim 11, wherein the holder unit further comprises a spring for resiliently supporting the support unit.

13. A finishing apparatus that imparts hairlines extending continuously along a plane surface and a curved surface of a sheet metal, the apparatus comprising:

a closed belt of sandpaper coated with particles of strong magnetic substance;

rotatable rollers having a relative orientation that defines a closed and curved path and being configured to facilitate rotational movement of the sandpaper along the closed and curved path;

a holder unit, arranged between at least two of the rotatable rollers, to engage the sheet metal and to facilitate contact between a surface of the sheet metal and an opposing surface of the sandpaper; and a magnet disposed at the holder unit.

14. The apparatus as claimed in claim 13, wherein the holder unit comprises:

a support unit in which the sheet metal is inserted; and an XY table for operating the support unit within the plane surface, wherein the magnet is inserted into the support unit.

* * * * *